US010114328B2

(12) United States Patent
Miyake et al.

(10) Patent No.: US 10,114,328 B2
(45) Date of Patent: Oct. 30, 2018

(54) SHEET FEEDING DEVICE AND IMAGE FORMING APPARATUS

(71) Applicant: CANON KABUSHIKI KAISHA, Tokyo (JP)

(72) Inventors: Toshiyuki Miyake, Abiko (JP); Satoru Yamamoto, Noda (JP); Takashi Yokoya, Yoshikawa (JP); Katsuya Nakama, Nagareyama (JP); Koji Yumoto, Toride (JP); Riki Fukuhara, Kashiwa (JP); Akihiro Kawakita, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/098,171

(22) Filed: Apr. 13, 2016

(65) Prior Publication Data

US 2016/0306312 A1 Oct. 20, 2016

(30) Foreign Application Priority Data

Apr. 17, 2015 (JP) ..... 2015-085302

(51) Int. Cl.
*B65H 5/00* (2006.01)
*G03G 15/00* (2006.01)
(Continued)

(52) U.S. Cl.
CPC ..... *G03G 15/657* (2013.01); *B65H 1/08* (2013.01); *B65H 7/20* (2013.01); *G03G 15/6511* (2013.01); *B65H 2553/82* (2013.01); *B65H 2701/1916* (2013.01); *G03G 2215/004* (2013.01); *G03G 2215/00396* (2013.01);
(Continued)

(58) Field of Classification Search
CPC ..... G03G 2215/00784; G03G 2215/00514; B65H 2701/1916; B65H 2553/82
See application file for complete search history.

(56) References Cited

U.S. PATENT DOCUMENTS 5,893,554 A * 4/1999 Okahashi ..... B65H 3/128 271/104
8,262,080 B2 * 9/2012 Matsumoto ..... B65H 1/14 271/97

(Continued)

FOREIGN PATENT DOCUMENTS

JP H10-77123 A 3/1998

*Primary Examiner* — Howard J Sanders
(74) *Attorney, Agent, or Firm* — Canon U.S.A., Inc. IP Division

(57) ABSTRACT

An apparatus includes a movable regulation member that regulates a trailing edge side position of a sheet stack stored in a storage portion in a sheet feeding direction, a trailing edge detection portion, movable together with the regulation member, that detects a sheet surface on the trailing edge side of the sheet stack, and a control unit that detects whether the regulation member is positioned to an end surface on the trailing edge side of the sheet stack based on a detection result by the trailing edge detection portion, and that causes a display unit to provide a warning if the regulation member is not positioned to the end surface, wherein, if a predetermined sheet with thicknesses different between leading edge and trailing edge sides thereof in the sheet feeding direction is set by a setting unit, the control unit does not cause the display unit to provide the warning.

15 Claims, 15 Drawing Sheets

(51) Int. Cl.
*B65H 1/08* (2006.01)
*B65H 7/20* (2006.01)

(52) U.S. Cl.
CPC ..... *G03G 2215/00514* (2013.01); *G03G 2215/00725* (2013.01); *G03G 2215/00784* (2013.01)

(56) References Cited

U.S. PATENT DOCUMENTS

2007/0228639 A1* 10/2007 Matsumoto ..... B65H 1/14
271/97
2013/0193633 A1* 8/2013 Yamazaki ..... B65H 5/00
271/12
2015/0183595 A1* 7/2015 Yokoya ..... B65H 1/266
271/9.01

* cited by examiner

SHEET FEEDING DEVICE AND IMAGE FORMING APPARATUS

BACKGROUND OF THE INVENTION

Field of the Invention

Aspects of the present invention generally relate to a sheet feeding device, which separates and feeds sheets on a sheet-by-sheet basis from a stack of sheets (a sheet stack) stacked on a sheet storage portion, and an image forming apparatus including the sheet feeding device.

Description of the Related Art

In image forming systems, such as printers, copying machines, and facsimile apparatuses, a sheet feeding device that separates and feeds sheets on a sheet-by-sheet basis from a sheet stack stacked on a sheet storage portion is conventionally known.

Furthermore, due to growing user needs in recent years, demands for performing image formation on sheets of various sizes have been increasing.

Japanese Patent Application Laid-Open No. 10-77123 discusses a sheet feed cassette capable of preventing double feed, non-feed, or other failed feed by ensuring the consistency of leading edge portions in the conveyance direction of stored sheets regardless of sizes of the stored sheets and keeping the press-contact force of a sheet feed roller onto the sheets constant. More specifically, the sheet feed cassette includes a trailing edge guide configured to regulate trailing edges of a stack of stored sheets and having a height of stacking that is variable according to sheet sizes.

However, with regard to the sheet feed cassette discussed in Japanese Patent Application Laid-Open No. 10-77123, although the user performs an operation of adjusting the position of the trailing edge guide so as to regulate the trailing edges of a sheet stack, the position of the trailing edge guide may not be correctly adjusted in some cases.

As one of methods for determining whether the position of the trailing edge guide is correct, there can be conceived a method in which the trailing edge guide is provided with a trailing edge regulation member and a sensor. FIGS. 2A, 2B, and 2C illustrate a specific configuration of a sheet feeding device to which such a method is applied.

The sheet feeding device illustrated in FIGS. 2A, 2B, and 2C is provided with an air separation feeding mechanism that suctions a sheet with air suction by a suction fan, which is located above the sheet stack, and conveys the suctioned sheet. Moreover, the sheet feeding device is also provided with a configuration for determining whether the positional adjustment of the trailing edge guide 504 has been correctly performed (hereinafter referred to as "trailing-edge rough-setting detection").

In the trailing-edge rough-setting detection, the details of which are described later below, when, for example, a sheet with thicknesses different between leading and trailing edges thereof in the sheet feeding direction, such as an envelope illustrated in FIG. 3, is set in a sheet feeding device, the upper surface of a sheet stack becomes aslant as illustrated in FIG. 2C. If the above-mentioned trailing-edge rough-setting detection is implemented on the sheet stack, the condition of the sheet stack may be erroneously detected.

More specifically, in the sheet feeding device, at the time when a sensor 525 is turned on as a lifter 505 is moved up, the upward movement of the lifter 505 is stopped. In a case where the envelope is set with a flap portion thereof set as the trailing edge side in the sheet feeding direction, the state such as that illustrated in FIG. 2C appears. Therefore, despite the trailing edge guide 504 being correctly set, the upper surface of the sheet stack 501 does not come into contact with a trailing edge detection member 160, and, as a result, a sensor 161 mounted on the trailing edge guide 504 does not come into a detected condition. Accordingly, the sheet feeding device may erroneously determine that the trailing edge guide 504 is not correctly set.

In this way, in a sheet feeding device provided with both the air separation feeding mechanism and the trailing-edge rough-setting detection mechanism, a determination as to whether the positional adjustment of the trailing edge guide has been correctly performed may result in an erroneous detection.

SUMMARY OF THE INVENTION

According to an aspect of the present invention, an image forming apparatus includes a storage portion configured to store a sheet stack including a plurality of sheets, a setting unit configured to set a type of sheets that are stored in the storage portion, a lifting and lowering portion configured to move up and down the sheet stack stored in the storage portion, a feeding portion configured to feed a sheet from the sheet stack stored in the storage portion, a regulation member being movable and configured to regulate a position on a trailing edge side of the sheet stack stored in the storage portion in a feeding direction in which the feeding portion feeds a sheet, a display unit configured to display information, a trailing edge detection portion being movable together with the regulation member and configured to detect a sheet surface on the trailing edge side of the sheet stack, and a control unit configured to perform a detection operation for detecting whether the regulation member is positioned to an end surface on the trailing edge side of the sheet stack based on a result of detection by the trailing edge detection portion, and configured to cause the display unit to provide a warning display if it is detected that the regulation member is not positioned to the end surface, wherein, in a case where a predetermined sheet having thicknesses different between a leading edge side and a trailing edge side of the predetermined sheet in the feeding direction is set by the setting unit, the control unit does not cause the display unit to provide the warning display.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

(Overall Configuration)

Figure 1:
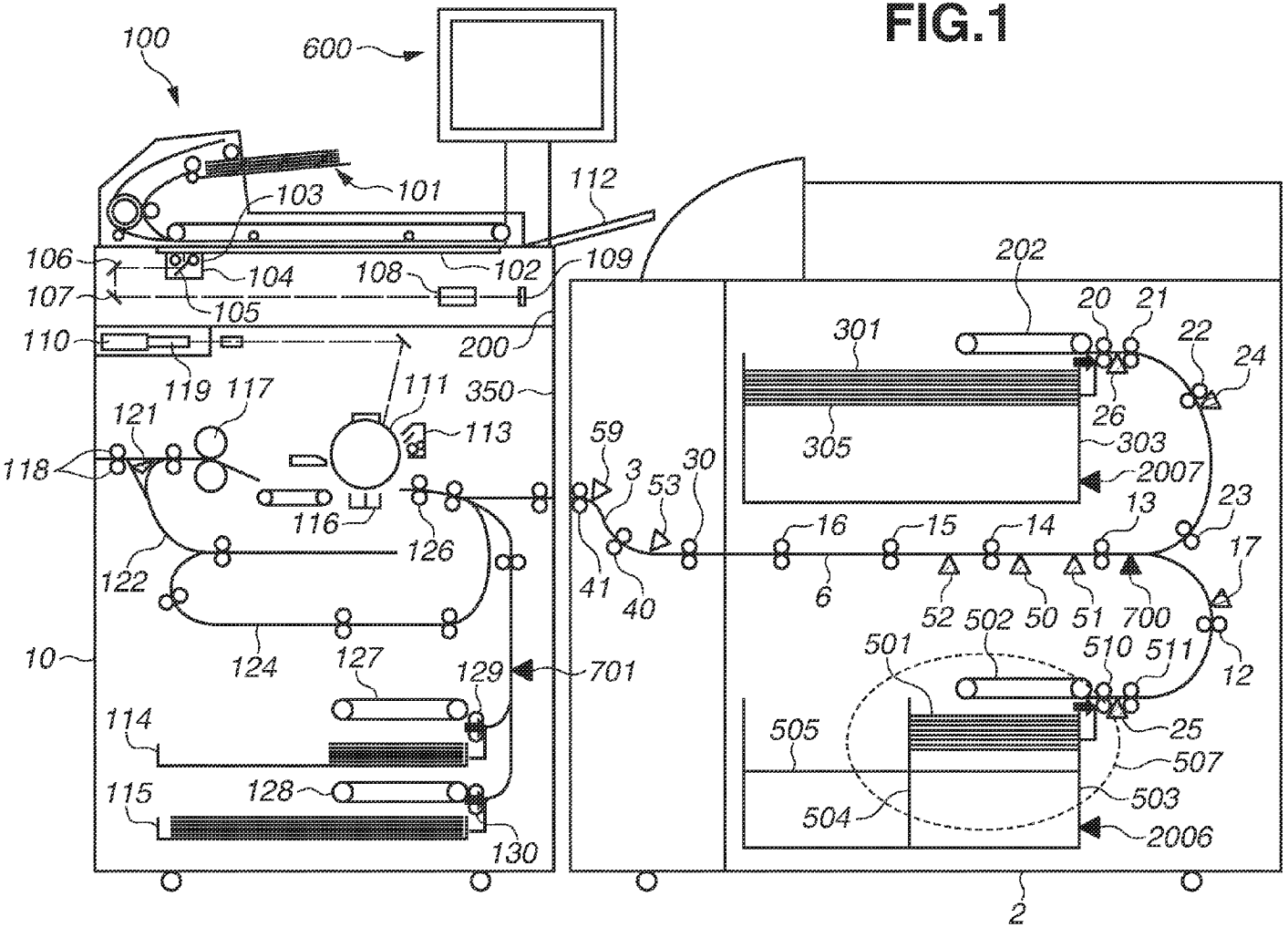
FIG. 1 is a sectional view of an image forming system according to a first exemplary embodiment.

FIG. 1 is a configuration diagram illustrating a longitudinal cross section structure of main components of an image forming system according to a first exemplary embodiment of the present invention. The image forming system includes an image forming apparatus 10 and a sheet feeding device 2, as illustrated in FIG. 1. The image forming apparatus 10 includes an image reader 200, which reads an image of a document, and a printer 350, which forms the read image on a sheet.

A document feeding device 100 feeds a document, which is set on a document tray 101 with an image surface of the document face up, one page at a time in order from the first page toward the left as viewed in FIG. 1, and then discharges the document, which is conveyed on a platen glass 102 from the left after passing through a curved path, to a sheet discharge tray 112 via a predetermined reading position. When the document passes on the platen glass 102 from the left to the right, an image of the document is read by a scanner unit 104, which is stopped at a position corresponding to the predetermined reading position. When the document passes through the reading position, the document is illuminated with light emitted from a lamp 103 of the scanner unit 104, and reflected light from the illuminated document is guided to a lens 108 via mirrors 105, 106, and 107. The light having passed through the lens 108 is focused on the imaging surface of an image sensor 109.

In this way, while, when the document passes through the reading position, the document image is read by the image sensor 109 one line at a time in the main scanning direction, the document is conveyed in the sub scanning direction, so that the entire document image is read. The optically read image is converted by the image sensor 109 into image data, which is then output from the image sensor 109. The image data output from the image sensor 109 is input as a video signal to an exposure unit 110 of the printer 350. Furthermore, such a configuration is available that the document feeding device 100 conveys the document on the platen glass 102 and stops the document at the reading position and, in this state, the scanner unit 104 moves for scanning from the left to the right, thus enabling reading the document image.

The exposure unit 110 of the printer 350 modulates laser light based on the video signal input from the image reader 200 and outputs the modulated laser light. The laser light is thrown by a polygon mirror 119 for scanning on a photosensitive drum 111. Then, an electrostatic latent image corresponding to the laser light thrown for scanning is formed on the photosensitive drum 111. The electrostatic latent image formed on the photosensitive drum 111 is then made visible as a developer image with a developer supplied from a developing device 113.

On the other hand, a sheet that has been fed from an upper cassette 114 or a lower cassette 115, which is contained in the printer 350, by a suction belt 127 or 128 is conveyed up to a registration roller pair 126 by a pull-out roller pair 129 or 130. At that time, the presence of absence of double feed, in which two or more sheets overlapping each other are fed at a time, is detected by a double-feed sensor 701, which detects double feed.

After the leading edge of a sheet has reached the registration roller pair 126, which is stopped, the registration roller pair 126 is driven at timing synchronized with the start of radiation of laser light, so that the sheet is conveyed to between the photosensitive drum 111 and a transfer portion 116. The developer image formed on the photosensitive drum 111 is transferred to the fed sheet by the transfer portion 116. The sheet having the developer image transferred thereto is conveyed to a fixing portion 117, and the fixing portion 117 heats and presses the sheet to have the developer image fixed to the sheet. The sheet having passed through the fixing portion 117 is discharged from the printer 350 to the outside of the image forming apparatus 10 via a flapper 121 and a discharge roller pair 118.

(Block Diagram of Entire System)

Figure 4:
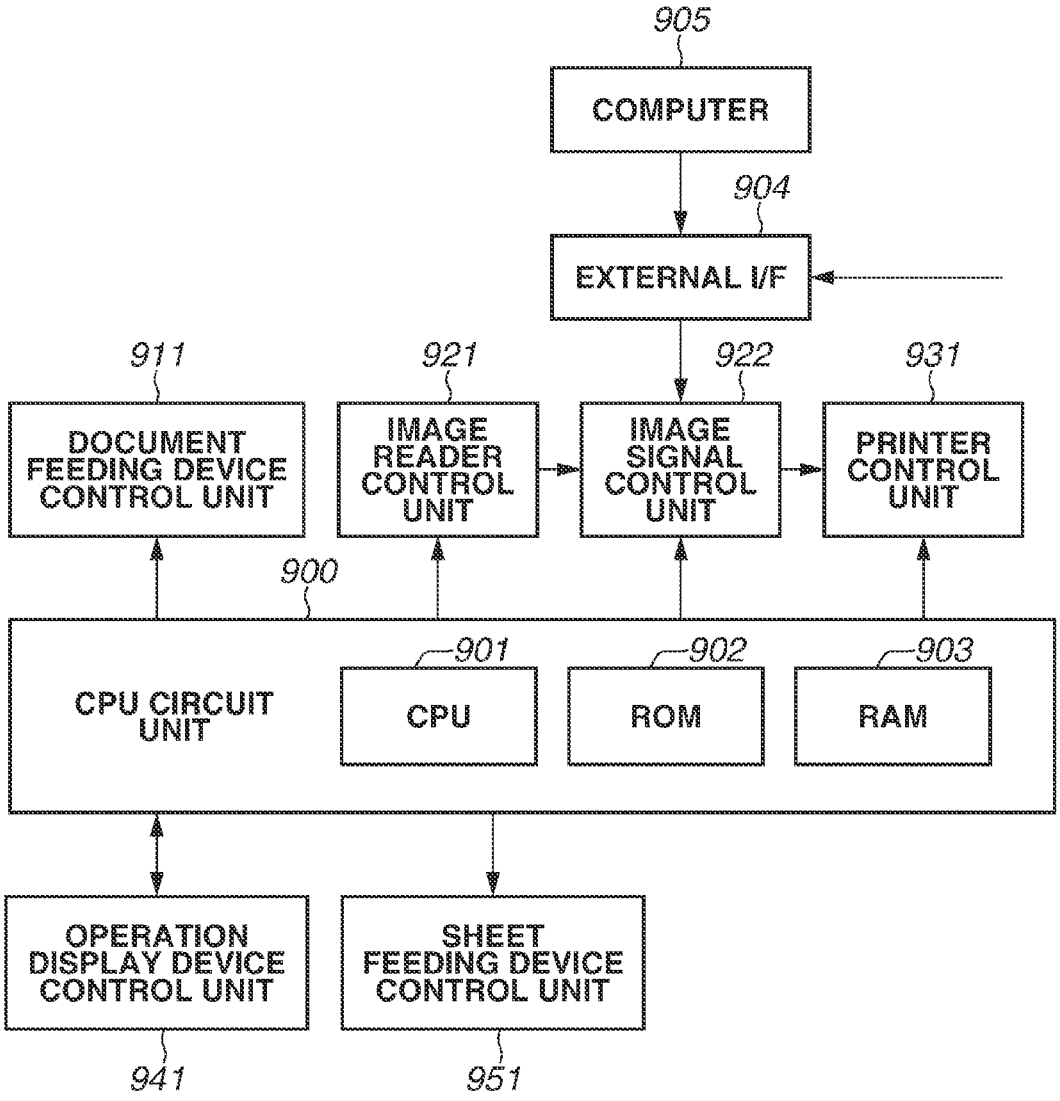
FIG. 4 is a control block diagram of the image forming system.

FIG. 4 is a control block diagram of the entire image forming system illustrated in FIG. 1.

A central processing unit (CPU) circuit unit 900 contains a CPU 901, a read-only memory (ROM) 902, and a random access memory (RAM) 903. The CPU 901 is a CPU that performs basic control over the entire image forming system, to which the ROM 902 and the RAM 903 are connected via an address bus and a data bus. The CPU 901 comprehensively controls respective control units 911, 921, 922, 904, 931, 941, and 951 according to control programs stored in the ROM 902. The RAM 903 temporarily retains data, and is used as a work area for computation processing associated with control.

A document feeding device control unit 911 controls the document feeding device 100 based on an instruction from the CPU circuit unit 900. An image reader control unit 921 performs control over the above-mentioned scanner unit 104, the image sensor 109, and other components in the image reader 200, and transfers an image signal output from the image sensor 109 to an image signal control unit 922.

The image signal control unit 922 converts an analog image signal output from the image sensor 109 into a digital signal, performs processing on the digital signal, further converts the processed digital signal into a video signal, and then outputs the video signal to a printer control unit 931. Furthermore, the image signal control unit 922 performs various processing operations on a digital image signal input from a computer 905 via an external interface (I/F) 904, converts the processed digital image signal into a video signal, and then outputs the video signal to the printer control unit 931. The processing operations performed by the image signal control unit 922 are controlled by the CPU circuit unit 900. The printer control unit 931 controls the exposure unit 110 and the printer 350 based on the input video signal to perform image formation and sheet conveyance.

A sheet feeding device control unit 951 performs drive control over the sheet feeding device 2 by exchanging information with the CPU circuit unit 900. The contents of the drive control are described later below.

An operation display device control unit 941 exchanges information with an operation display device 600 and the CPU circuit unit 900. The operation display device 600 includes a plurality of keys operable to set various functions related to image formation, a display unit for displaying information indicating a setting state, and other components. The operation display device 600 outputs a key signal corresponding to an operation on each key to the CPU circuit unit 900, and displays information corresponding to a signal output from the CPU circuit unit 900.

(Operation Display Device)

Figure 6:
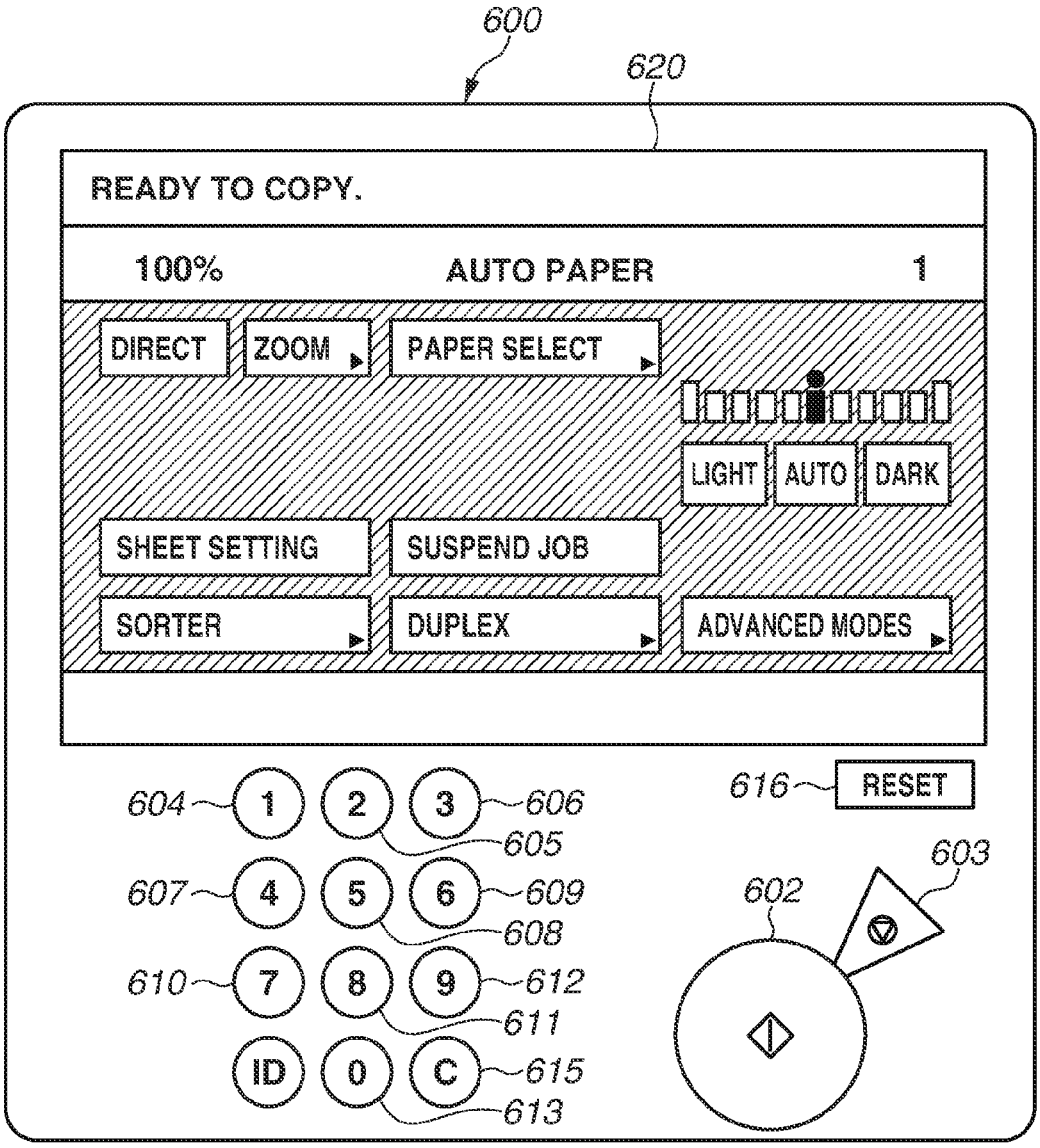
FIG. 6 illustrates an operation display device.

FIG. 6 illustrates the operation display device 600 in the image forming apparatus 10 illustrated in FIG. 1. The operation display device 600 includes a start key 602, which is operable to start an image forming operation a stop key 603, which is operable to stop the image forming operation, a numeric keypad (keys 604 to 613), which is operable to enter a numeral, and a clear key 615, which is operable to bring back the entered numeral to "1". The operation display device 600 further includes a reset key 616, which is operable to bring back the set operation mode to a default mode. Furthermore, a display portion 620 equipped with a touch panel is mounted at the upper half portion of the operation display device 600, and a software keyboard can be displayed on the display portion 602.

(Sheet Feeding Device)

Next, a configuration of the sheet feeding device 2 is described with reference to FIG. 1. The sheet feeding device 2 includes a sheet storage portion 503, which stores a sheet stack 501. The sheet storage portion 503 is provided with a trailing edge guide 504, serving as a regulation member, on the trailing edge side in the conveyance direction of the sheet stack 501. The trailing edge guide 504 is configured to be movable, and is manually moved according to the size of the sheet stack 501. The position of the sheet stack 501 is regulated by the trailing edge guide 504 contacting the end surface on the trailing edge side of the sheet stack 501 such that the leading edge side of the sheet stack 501 is aligned with the leading edge side in the conveyance direction of the sheet storage portion 503. Furthermore, the sheet storage portion 503 is also provided with a lifter 505, which is a member configured to move up and down the sheet stack 501 stored in the sheet storage portion 503. The sheet storage portion 503 is further provided with a lower limit sensor 2006 at the lowest position up to which the lifter 505 is able to be moved down. When the lower limit sensor 2006 has detected the lifter 505, the lifter 505 is stopped from moving down.

Next, an air separation feeding mechanism used for sheets is described with reference to FIGS. 2A, 2B, and 2C, FIG. 3, and FIG. 5.

Figure 2A:
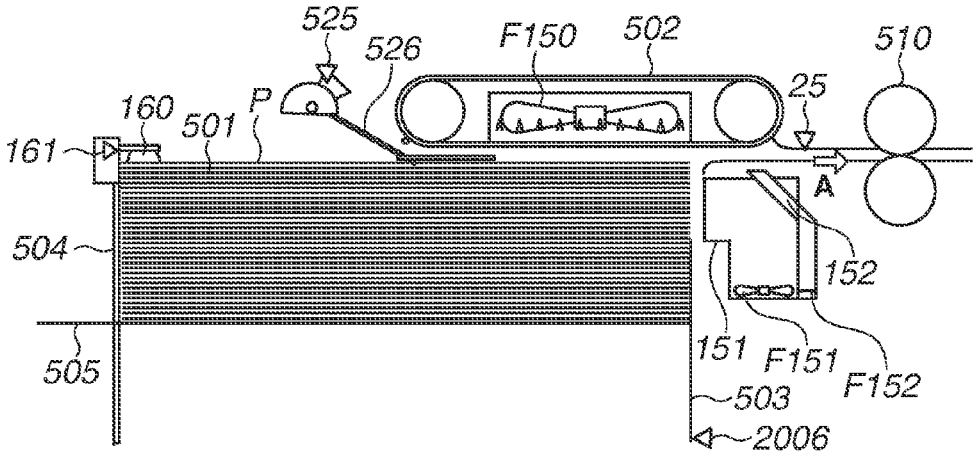
FIGS. 2A, 2B, and 2C illustrate a sheet feeding device.

When a loosening fan F151 is rotated as a preparatory operation for sheet feeding in a separation feeding portion 507 (FIG. 1), air is blown out from a loosening nozzle 151, so that loosening of sheets in the upper portion of the sheet stack 501 is started. Furthermore, when sheet feeding is performed, a negative pressure, in other words, a suction force, is generated inside a suction belt 502 by a suction fan F150, so that only one sheet P, which is the upper most sheet in the sheet stack 501, is attracted to the suction belt 502 (FIG. 2A). After a predetermined time, the rotation of the suction belt 502 is started by a suction belt motor M102 with the sheet P attracted to the suction belt 502, so that the sheet P is conveyed in the direction of arrow A. When the leading edge of the sheet P has reached a belt pulley portion, the leading edge portion of the sheet P is released from a suction force generated by the suction fan F150, is moved away from the suction belt 502, and is then passed to a pull-out roller pair 510. When the leading edge of the uppermost sheet P in the sheet storage portion 503 has reached the pull-out roller pair 510, since a negative pressure generated by the suction fan F150 is released, the sheet P is released from a suction force, which attracts the sheet P to the suction belt 502, so that the sheet P is conveyed only by the conveyance force of the pull-out roller pair 510. After the trailing edge of the sheet P leaves the suction belt 502, the above-mentioned feeding operation is started at predetermined timing, and the separation feeding of a next sheet is started.

In the above-described sheet feeding operation, although driving of the loosening fan F151 is started as a preparatory operation for sheet feeding before a feeding start signal is provided, the separation feeding portion 507 may be controlled such that driving of the loosening fan F151 is started immediately before sheet feeding is performed.

Also in a sheet storage portion 303 (FIG. 1), a feeding operation similar to the above-described operation is performed. Furthermore, the operation display device 600 illustrated in FIG. 6 can be used to set sheet information, such as size, material, and grammage, of sheets that are stored in the respective sheet storage portions 503 and 303.

Moreover, each of the sheet storage portions 503 and 303 is capable of storing a sheet with thicknesses different between leading edge and trailing sides thereof in the feeding direction, for example, an envelope having a flap (seal flap). In a case where such an envelope is stored, it is supposed that the envelope is stored with a side having the flap set as the trailing edge side and with the flap opened (unfolded).

(Sheet Feeding Device Control Unit)

Figure 5:
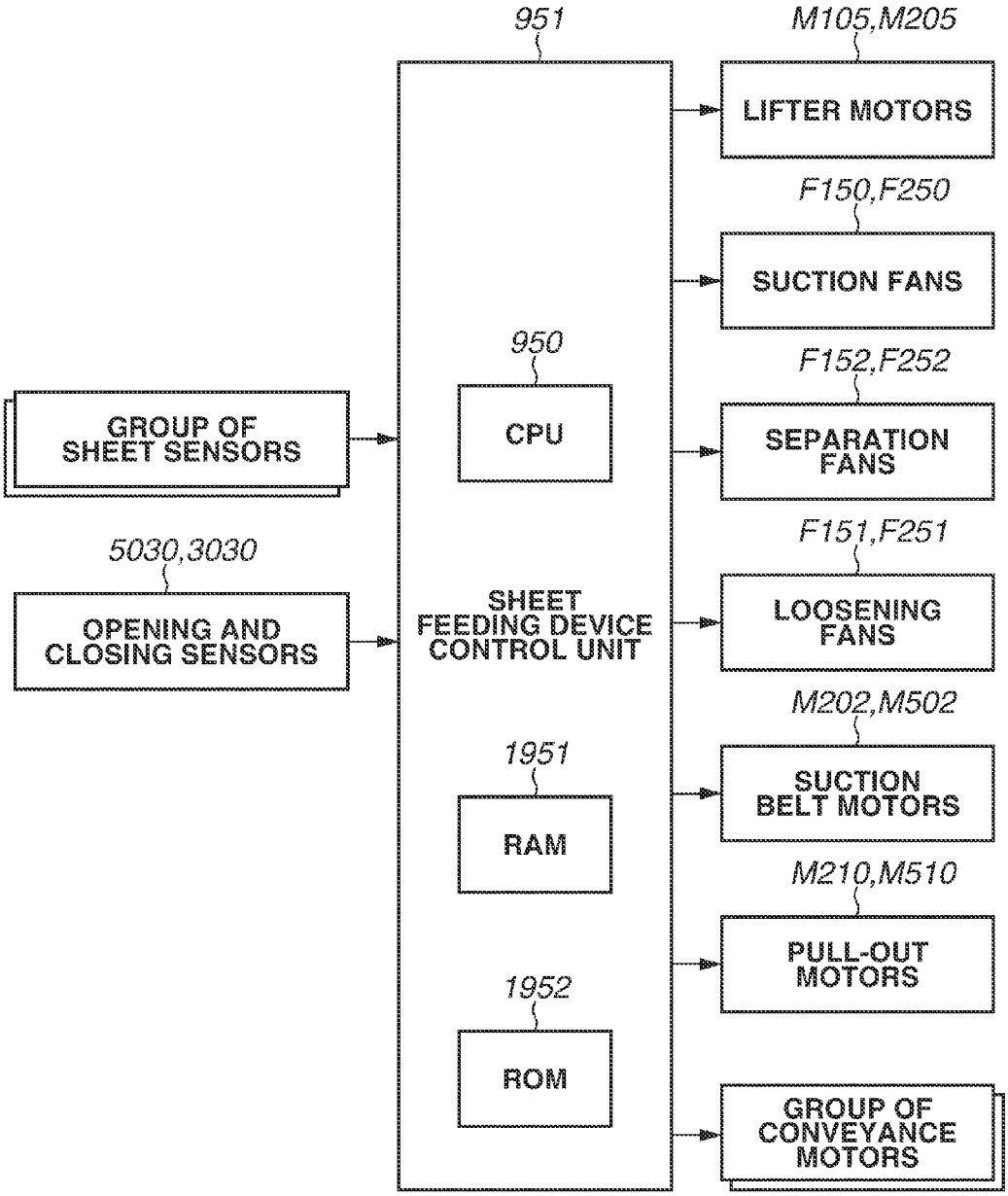
FIG. 5 is a control block diagram of the sheet feeding device.

FIG. 5 is a control block diagram illustrating a configuration of the sheet feeding device control unit 951. The sheet feeding device control unit 951 contains a CPU 950, a RAM 1951, and a ROM 1952. Furthermore, the sheet feeding device control unit 951 performs drive control over lifter motors M105 and M205, which move up and down lifters 305 and 505, respectively, suction fans F150 and F250, separation fans F152 and F252, and loosening fans F151 and F251. The sheet feeding device control unit 951 further performs drive control over suction belt motors M202 and M502, which drive belts 302 and 502, respectively, pull-out motors M210 and M510, and a group of conveyance motors, which drive respective conveyance rollers, based on signals output from various sheet sensors.

A double-feed sensor 700 (FIG. 1) detects a state in which two or more sheets overlapping each other, which are fed from the sheet storage portion 503 or 303, are fed at a time, which is referred to as double feed.

Furthermore, each of the sheet storage portions 503 and 303 is provided with an opening button (not illustrated) for opening a door via which to access the inside of the sheet storage portion 503 or 303. When the opening button is pressed, the door of the sheet storage portion 503 or 303 is opened, so that the user can replenish the sheet storage portion 503 or 303 with sheets.

Moreover, the sheet storage portions 503 and 303 are provided with opening and closing sensors 5030 and 3030, respectively, which detect opening and closing states of doors of the sheet storage portions 503 and 303.

(Method for Setting Sheet Information and Job)

When the user has set sheets in the sheet storage portion 503 or 303, it is necessary to register information on the set sheets. In the following, a method for setting sheet information, such as size, material, and grammage, of sheets stored in the sheet storage portion 503 or 303 is described with reference to FIGS. 7A, 7B, 7C, and 7D.

Figure 7A:
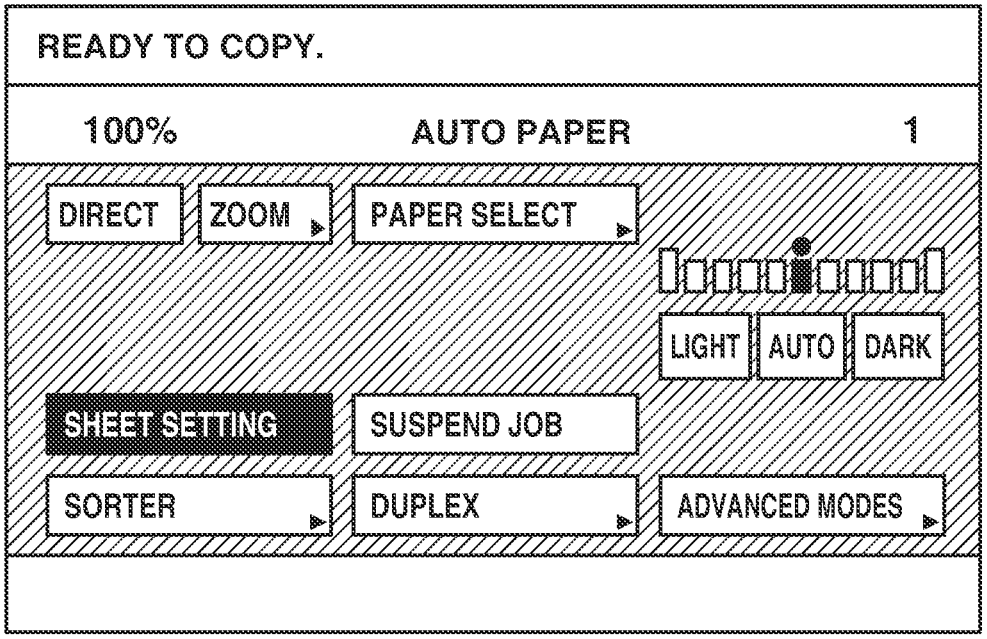
FIGS. 7A, 7B, 7C, and 7D illustrate setting screens for a job.
Figure 7B:
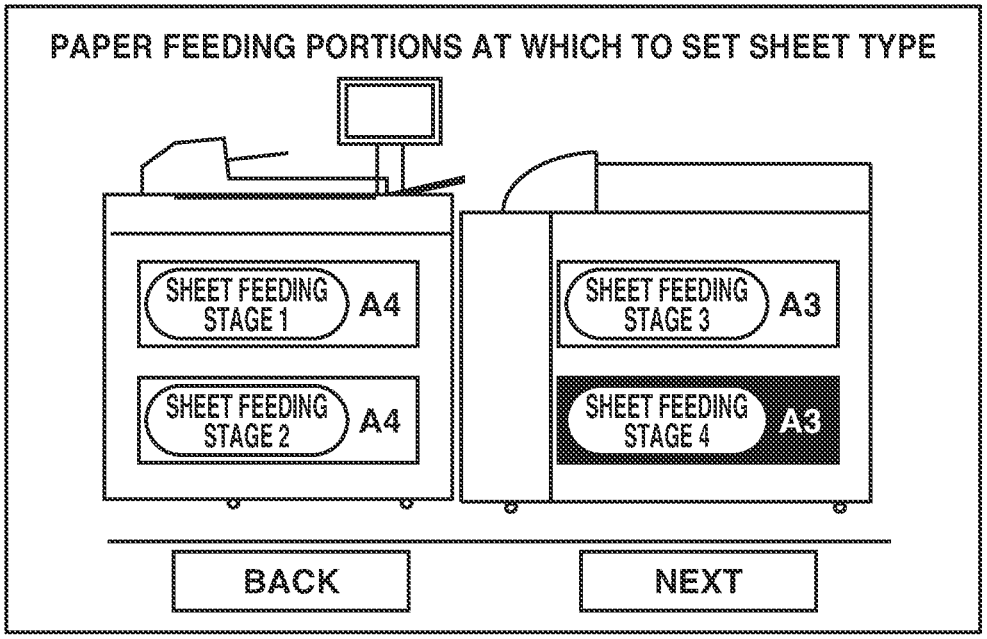
Figure 7C:
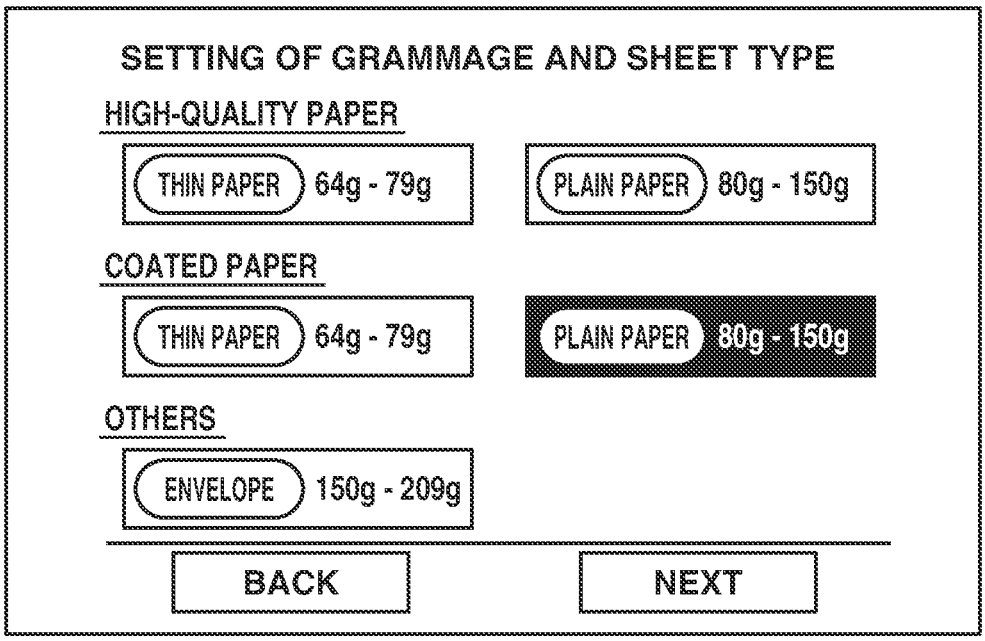
Figure 7D:
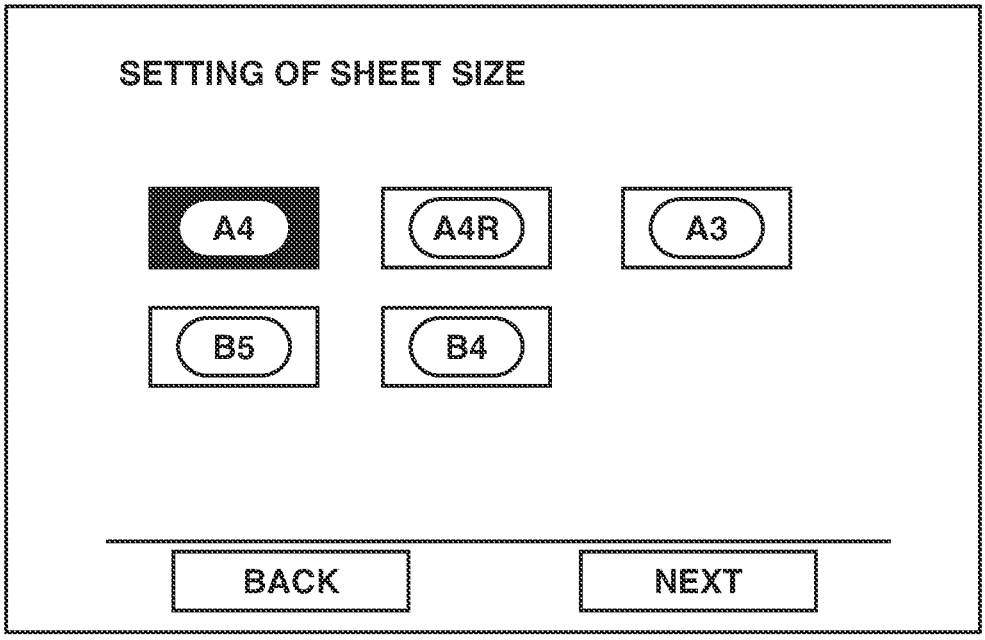

When the user presses a "paper select" button illustrated in FIG. 7A on the display portion 620 illustrated in FIG. 6, a setting screen illustrated in FIG. 7B is displayed by the CPU 901. The user first selects at which sheet storage portion to set sheet information. In the present exemplary embodiment, the user selects a sheet storage portion from among a total of four sheet storage portions, including two sheet storage portions contained in the image forming apparatus 10 and two sheet storage portions contained in the sheet feeding device 2. When the user selects any one of the sheet storage portions and presses a "next" button, a setting screen for sheet grammage and material illustrated in FIG. 7C is displayed by the CPU 901. When the user selects a desired sheet grammage and material and presses a "next" button, a setting screen for sheet size illustrated in FIG. 7D is displayed by the CPU 901. When the user selects a desired sheet size and presses a "next" button, the setting screen shifts to the initial screen illustrated in FIG. 7A, so that a process for registering sheet information ends.

(Trailing-Edge Rough-Setting Detection Operation)

Next, the outline of the trailing-edge rough-setting detection for the trailing edge guide 504 is described with reference to FIGS. 2A, 2B and 2C. As mentioned in the foregoing, the trailing edge guide 504 is required to be set at an appropriate position according to the size of sheets stored in the sheet storage portion 503. However, since the trailing edge guide 504 is manually positioned, the trailing edge guide 504 may not be set at a correct position. Therefore, a trailing edge position detection operation for determining where the trailing edge guide 504 has been set at an appropriate position (hereinafter referred to as "trailing-edge rough-setting detection") is performed. In the following, the trailing-edge rough-setting detection operation is described.

As illustrated in FIG. 2A, the surface of the uppermost sheet P in the sheet stack 501 is detected by a sheet surface sensor 525. Since a sheet surface detection member 526 is lifted up together with sheets by the rising operation of the lifter in the sheet storage portion and the loosening operation for the sheet stack 501 by the above-mentioned air separation feeding mechanism, a sensor flag of the sheet surface detection member 526 is moved so that the sheet surface sensor 525 can perform sheet surface detection.

Furthermore, the upper end of the trailing edge guide 504 is provided with a trailing edge detection member 160, which is lifted upward by the rising motion of sheets. When the trailing edge detection member 160 is lifted up by the trailing edge of the sheet stack 501, a trailing edge sensor 161 detects the rise of the trailing edge detection member 160. This state means that the trailing edge guide 504 and the sheet stack 501 are correctly in contact with each other. In other words, this state indicates that the trailing edge guide 504 is correctly positioned with respect to the sheet stack 501.

Figure 2B:
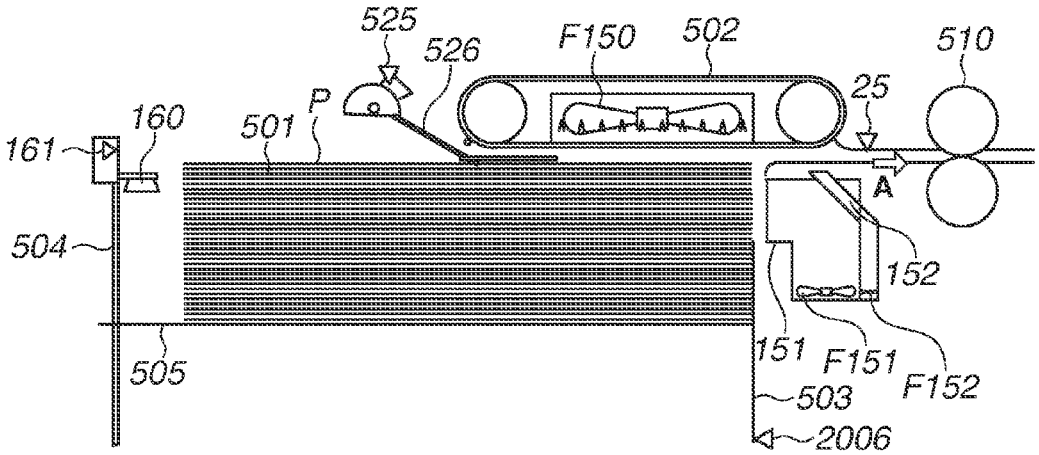

On the other hand, a case where, as illustrated in FIG. 2B, the trailing edge guide 504 is not correctly positioned with respect to the trailing edge of the sheet stack 501 is described. FIG. 2B illustrates a state in which the surface of the uppermost sheet in the sheet stack 501 is detected by the sheet surface sensor 525. Therefore, essentially, the sheet stack 501 can be said to be located at a position where the trailing edge detection member 160 is lifted up by the sheet stack 501. In this way, a state in which the trailing edge detection member 160 is not lifted up despite the sheet surface being detected by the sheet surface sensor 525 indicates that the trailing edge guide 504 is not correctly positioned with respect to the sheet stack 501. In other words, whether the trailing edge guide 504 is positioned at the end surface on the trailing edge side of the sheet stack 501 is detected based on a result of detection provided by the trailing edge sensor 161 when the sheet stack 501 has been moved up until the sheet surface sensor 525 detects the sheet surface.

Figure 2C:
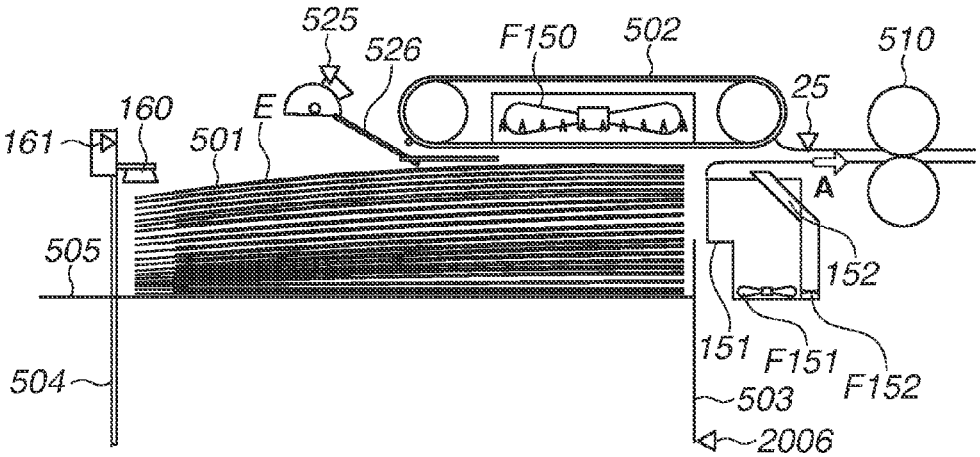
Figure 3:
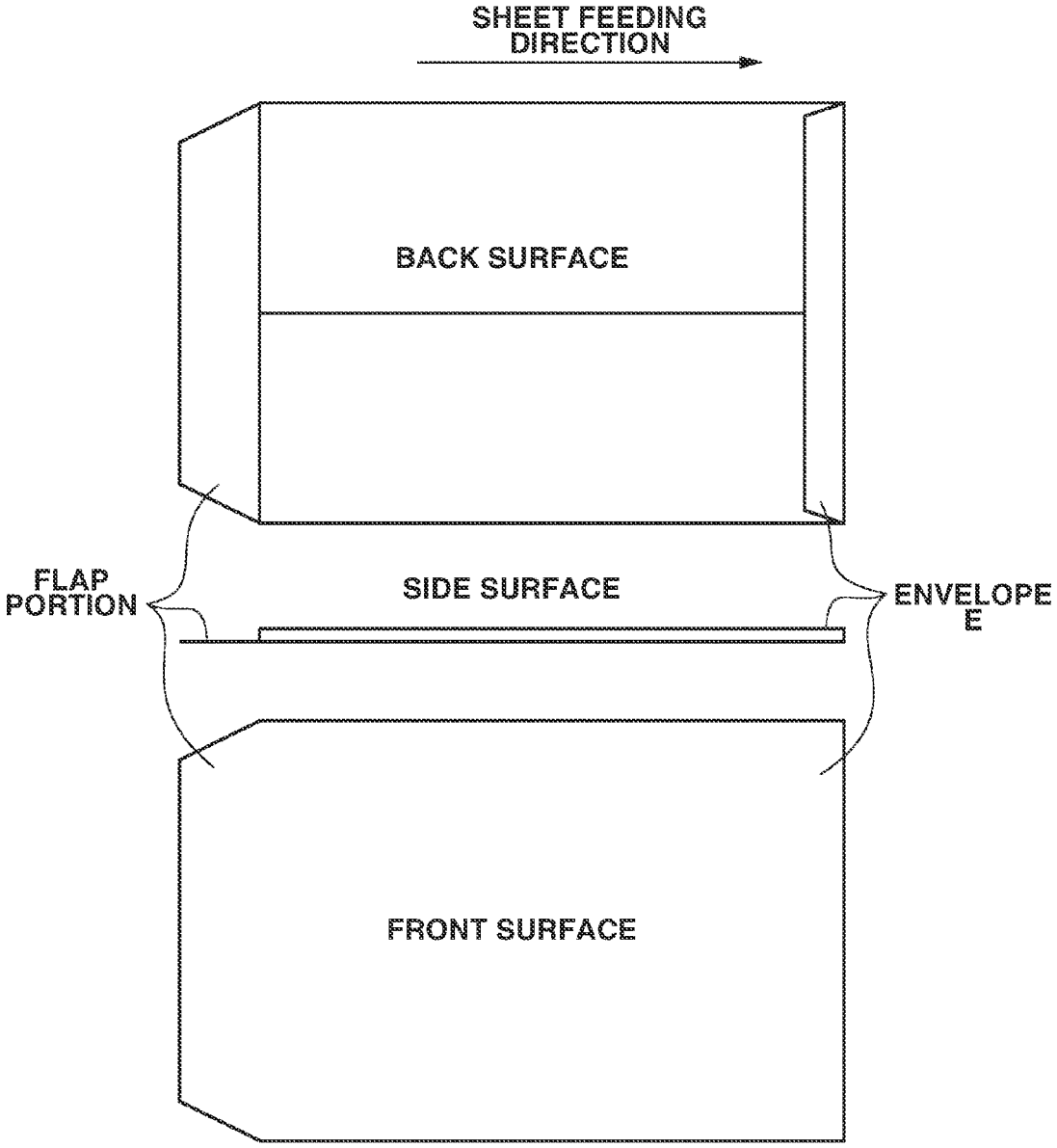
FIG. 3 illustrates an envelope.

FIG. 3 illustrates the form of an envelope used in the present exemplary embodiment. It is supposed that the user sets an envelope such as that illustrated in FIG. 3 in the sheet storage portion 503 in such a manner that the flap portion thereof is set as the trailing edge portion as viewed in the sheet feeding direction and the front surface is set face down. In general envelopes, the thickness of a portion in a pouch shape, which is opposite the flap portion, is larger than that of the flap portion. Therefore, the height on the leading edge side, in the sheet feeding direction, of a stack of envelopes becomes higher than the height on the trailing edge side of the stack of sheets. Accordingly, the state of the sheet storage portion 503 in a case where a stack of envelopes has been set in the sheet storage portion 503 and the above-described sheet surface detection operation has been performed becomes as illustrated in FIG. 2C. As illustrated in FIG. 2C, even when the sheet stack is moved up until the sheet surface sensor 525 detects the sheet surface, the trailing edge sensor 161 would not detect the sheet surface.

Figure 8:
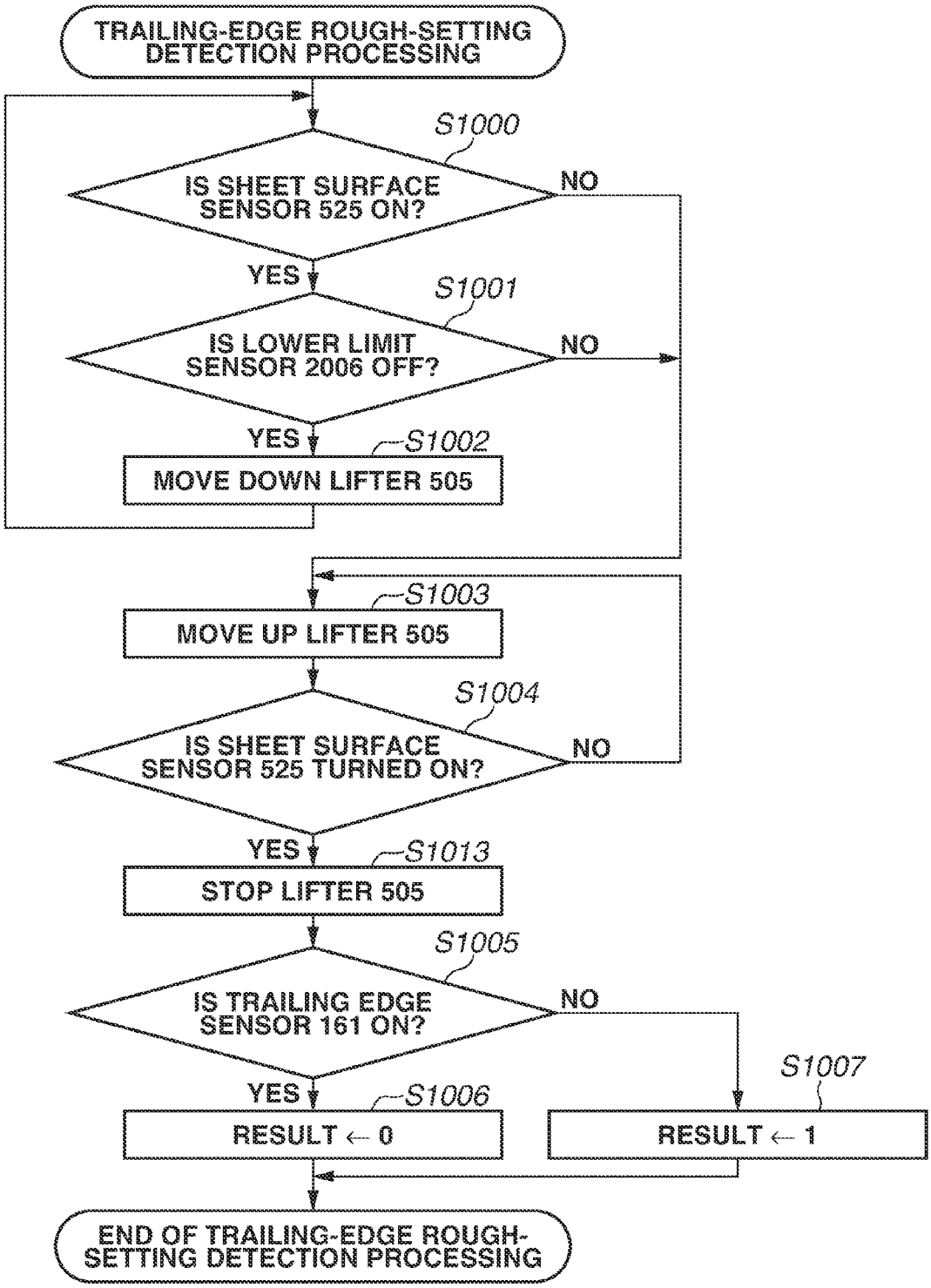
FIG. 8 is a flowchart illustrating trailing-edge rough-setting detection processing.
Figure 9:
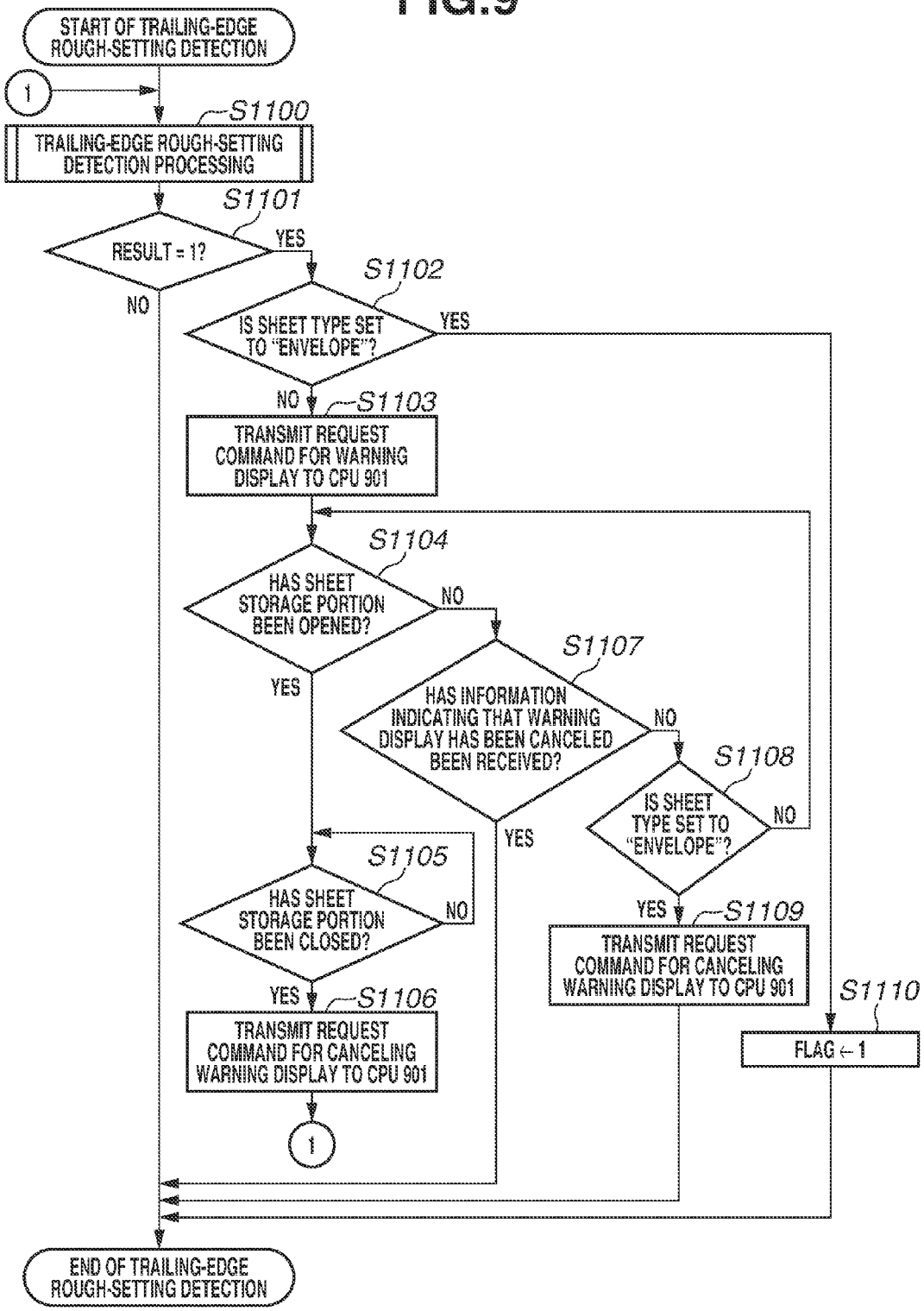
FIG. 9 is a flowchart illustrating the entire processing for a trailing-edge rough-setting detection operation.

Next, the trailing-edge rough-setting detection operation for the trailing edge guide 504 in the sheet storage portion 503 is described with reference to the flowcharts of FIGS. 8 and 9 and the diagram of FIG. 10. Processing illustrated in FIGS. 8 and 9 is performed by the CPU 950 of the sheet feeding device control unit 951.

First, the trailing-edge rough-setting detection processing is described with reference to the flowchart of FIG. 8.

In steps S1000 and S1001, the CPU 950 determines whether the sheet surface sensor 525 in the sheet storage portion 503 is on and whether the lower limit sensor 2006 is off, respectively. If the CPU 950 determines that the sheet surface sensor 525 is on and the lower limit sensor 2006 is off (YES in step S1000 and YES in step S1001), then in step S1002, the CPU 950 causes the lifter motor M205 to move down the lifter 505, thus moving down the sheet stack 501 to the position where the sheet surface sensor 525 is turned off. If the CPU 950 determines that the sheet surface sensor 525 is off (NO in step S1000), then in step S1003, the CPU 950 causes the lifter motor M205 to move up the lifter 505 until the sheet surface sensor 525 is turned on in step S1004. If the sheet surface sensor 525 is turned on (YES in step S1004), then in step S1013, the CPU 950 causes the lifter motor M205 to stop moving up the lifter 505. Furthermore, if, in step S1001, the lower limit sensor 2006 is not off (NO in step S1001), since the sheet surface sensor 525 is already turned on, the processing proceeds to step S1005 without the lifter 505 being moved up.

In step S1005, the CPU 950 determines whether the trailing edge sensor 161 is on. If the trailing edge sensor 161 is on (having detected the sheet surface) (YES in step S1005), then in step S1006, the CPU 950 assigns "0" to a variable RESULT, which is set in the RAM 1951, and terminates the trailing-edge rough-setting detection processing. The variable RESULT is a variable for storing a result of the trailing-edge rough-setting detection processing. The variable RESULT with a value of "0" indicates that the trailing edge guide 504 is not in a rough setting state. If the trailing edge sensor 161 is off (not having detected the sheet surface) (NO in step S1005), then in step S1007, the CPU 950 assigns "1" to the variable RESULT, and terminates the trailing-edge rough-setting detection processing. The variable RESULT with a value of "1" indicates that the trailing edge guide 504 is in a rough setting state, while the variable RESULT with a value of "0" indicates that the trailing edge guide 504 is correctly set.

Next, the entire operation for the trailing-edge rough-setting detection is described with reference to the flowchart of FIG. 9.

In step S1100, the CPU 950 performs the trailing-edge rough-setting detection processing illustrated in FIG. 8. After performing the trailing-edge rough-setting detection processing, in step S1101, the CPU 950 determines whether the value of the variable RESULT is "1". If the value of the variable RESULT is "0" (NO in step S1101), the CPU 950 terminates the trailing-edge rough-setting detection.

If the value of the variable RESULT is "1" (YES in step S1101), then in step S1102, the CPU 950 determines whether the type of sheets stored in the sheet storage portion 503 is set to "envelope".

If the sheet type is set to "envelope" (YES in step S1102), then in step S1110, the CPU 950 assigns "1" to a variable FLAG, which is set in the RAM 1951. The variable FLAG is a variable for storing information indicating not to provide a warning display although it is detected that the trailing edge guide 504 in the sheet storage portion 503 is not correctly positioned (being in a rough setting state). If, although the rough setting state has been detected, the warning display is not provided, "1" is set to the variable FLAG. More specifically, in a case where envelopes are stored in the sheet storage portion 503, as illustrated in FIG. 2C, even if the trailing edge guide 504 is correctly positioned, it may be determined, as a result of the trailing-edge rough-setting detection processing, that the trailing edge guide 504 is not correctly positioned. Accordingly, even if it is determined that the trailing edge guide 504 is in a rough setting state, in a case where the sheet type is set to "envelope", the warning display is not provided. Therefore, the user can be prevented from performing an extra operation.

Furthermore, if the sheet type is set to other than "envelope" (NO in step S1102), since this indicates that the trailing edge guide 504 is not correctly positioned, then in step S1103, the CPU 950 transmits, to the CPU 901, a command requesting displaying of a warning screen.

Figure 10:
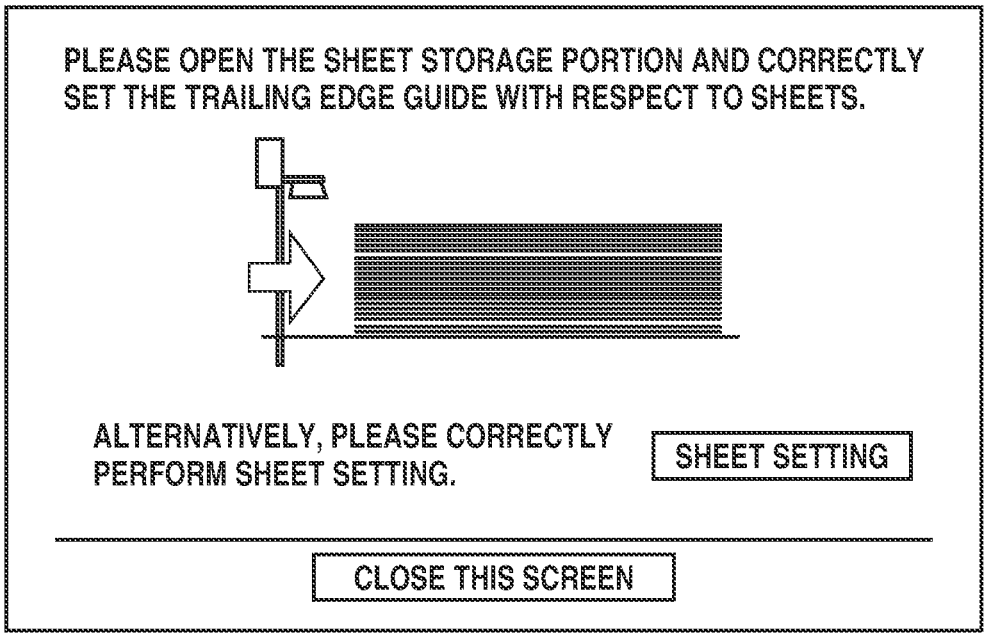
FIG. 10 illustrates a warning display screen.

FIG. 10 illustrates an example of the warning screen. A "close this screen" button, which is used to ignore this warning, and a "sheet setting" button, which is used to shift the warning screen to sheet setting change screens illustrated in FIGS. 7C and 7D, are displayed in the warning screen.

Then, in step S1104, the CPU 950 determines, via the opening and closing sensor 5030, whether the door of the sheet storage portion 503 has been opened. If the CPU 950 determines that the door has been opened (YES in step S1104), then in step S1105, the CPU 950 determines, via the opening and closing sensor 5030, whether the door of the sheet storage portion 503 has been closed. If the CPU 950 determines that the door has been closed (YES in step S1105), then in step S1106, the CPU 950 transmits, to the CPU 901, a command requesting cancellation of the warning display on the display portion 620. Then, the processing returns to step S1100. Furthermore, the CPU 901, when having detected the command, brings back the screen on the display portion 620 to the initial screen illustrated in FIG. 7A.

If, in step S1104, the door has not been opened (NO in step S1104), then in step S1107, CPU 950 determines whether status information indicating that the warning display on the display portion 620 has been canceled by the user's operation has been received from the CPU 901.

The status information mentioned in step S1107 is described now. When the "close this screen" button in the warning screen illustrated in FIG. 10 is pressed, the CPU 901 deletes the warning display and restores the initial screen illustrated in FIG. 7A, and then transmits the status information to the CPU 950. This case (YES in step S1107) corresponds to a state in which the trailing edge guide 504 is not correctly positioned with respect to the sheet stack 501. In this instance, the trailing-edge rough-setting detection ends.

If the CPU 950 has not received the above-mentioned status information from the CPU 901 (NO in step S1107), then in step S1108, the CPU 950 determines whether the type of sheets stored in the sheet storage portion 503 is set to "envelope". When the "sheet setting" button in the warning screen illustrated in FIG. 10 is pressed, the sheet setting screen illustrated in FIG. 7C is displayed, so that the user can perform the above-mentioned sheet setting. Here, when the user re-sets the type of sheets stored in the sheet storage portion 503 to "envelope", the CPU 950 determines that the type of sheets stored in the sheet storage portion 503 is "envelope" (YES in step S1108). Then, in step S1109, the CPU 950 transmits, to the CPU 901, a command requesting cancellation of the warning display on the display portion 620, and terminates the trailing-edge rough-setting detection. For example, in a case where, although the user has stored envelopes in the sheet storage portion 503, the user has forgotten to set the sheet type to "envelope", the warning screen illustrated in FIG. 10 would be displayed. When the "sheet setting" button in the warning screen illustrated in FIG. 10 is pressed and the sheet type is correctly set to "envelope", the determination in step S1108 results in "YES". Accordingly, if the user re-sets the sheet type to "envelope" before correcting the position of the trailing edge guide 504, the warning display is canceled.

Furthermore, if, in step S1108, the sheet type is not set to "envelope" (NO in step S1108), then in step S1104, the CPU 950 re-determines whether the door of the sheet storage portion 503 has been opened.

Figure 11:
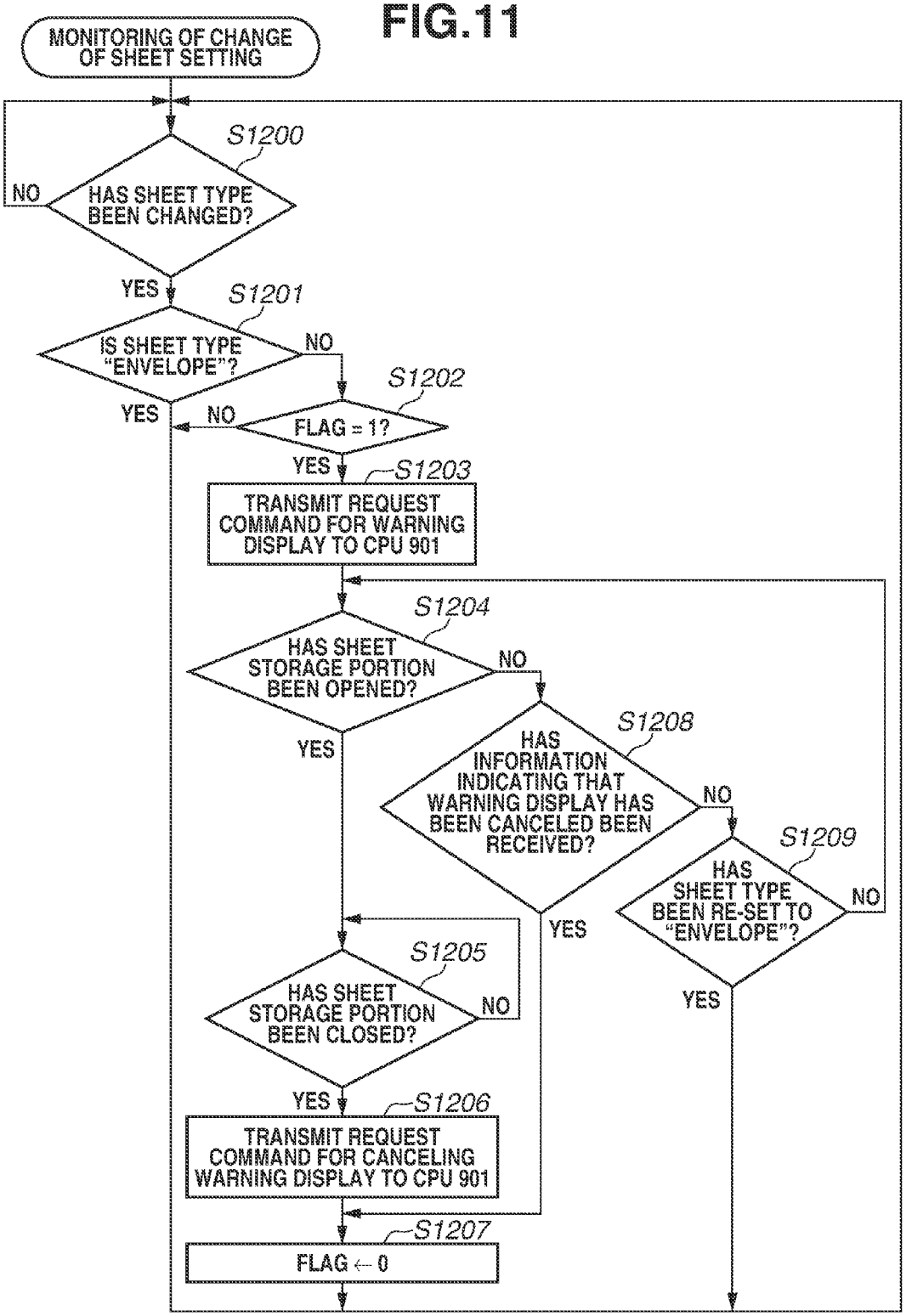
FIG. 11 is a flowchart illustrating processing for monitoring a change of sheet setting.

Next, processing for monitoring a change of setting of the type of sheets stored in the sheet storage portion 503, which is performed by the CPU 950, is described with reference to the flowchart of FIG. 11. This processing is periodically performed by the CPU 950 at intervals of a predetermined time. In this processing, when the sheet type is changed from "envelope" to another type in a case where it has been detected that the trailing edge guide 504 is in a rough setting state, as mentioned in the foregoing, the user is informed that the trailing edge guide 504 is in a rough setting state.

First, in step S1200, the CPU 950 determines whether the sheet setting in the sheet storage portion 503 has been changed. The CPU 950 repeats step S1200 until it is determined that the sheet setting has been changed.

If the CPU 950 determines that the sheet setting in the sheet storage portion 503 has been changed (YES in step S1200), then in step S1201, the CPU 950 determines whether the changed sheet type is "envelope". If the CPU 950 determines that the changed sheet type is "envelope" (YES in step S1201), the CPU 950 returns to step S1200 without performing the warning display processing caused by the trailing-edge rough-setting detection, thus repeating similar processing.

If the CPU 950 determines that the changed sheet type is other than "envelope" (NO in step S1201), then in steps S1202 to S1207, the CPU 950 performs the warning display processing caused by the trailing-edge rough-setting detection for the changed sheet type.

In step S1202, the CPU 950 determines whether the variable FLAG stored in the RAM 1951 is "1". The variable FLAG is set to "1", as mentioned in the foregoing, in a case where, although it has been detected that the trailing edge guide 504 is in a rough setting state, the warning screen illustrated in FIG. 10 is not displayed. If the CPU 950 determines that the variable FLAG is not "1" (NO in step S1202), the CPU 950 re-performs processing in step S1200. If the CPU 950 determines that the variable FLAG is "1" (YES in step S1202), then in step S1203, the CPU 950 transmits, to the CPU 901, a command requesting displaying of the warning screen. For example, suppose that, when envelopes are stored in the sheet storage portion 503, the user replaces the envelopes in the sheet storage portion 503 by sheets of the type other than envelope, closes the door of the sheet storage portion 503, and then sets the sheet type to the type other than envelope. Since the trailing-edge rough-setting detection is performed after the door of the sheet storage portion 503 is closed, if the trailing edge guide 504 is in a rough setting state, it is determined, prior to the sheet type being set, that the trailing edge guide 504 is in a rough setting state. However, since the setting of the sheet type is left as "envelope", the warning screen illustrated in FIG. 10 is not displayed. After that, in a situation in which the sheet type has been correctly set, the determination in step S1202 results in "YES".

Then, in step S1204, the CPU 950 determines, via the opening and closing sensor 5030, whether the door of the sheet storage portion 503 has been opened. If the CPU 950 determines that the door has been opened (YES in step S1204), then in step S1205, the CPU 950 determines, via the opening and closing sensor 5030, whether the door of the sheet storage portion 503 has been closed. If the CPU 950 determines that the door has been closed (YES in step S1205), then in step S1206, the CPU 950 transmits, to the CPU 901, a command requesting cancellation of the warning display on the display portion 620, and then in step S1207, the CPU 950 sets (resets) the variable FLAG to "0". This deletes information indicating that the rough setting state has been detected in the sheet storage portion 503. Furthermore, the CPU 901, when having detected the command, brings back the screen on the display portion 620 to the initial screen illustrated in FIG. 7A.

Until it is determined in step S1204 that the door has been opened, in step S1208, the CPU 950 determines whether status information indicating that the warning display on the display portion 620 has been canceled by the user has been received from the CPU 901. More specifically, when the "close this screen" button is pressed in the warning screen illustrated in FIG. 10, the CPU 901 deletes the warning display, brings back the screen to the initial screen illustrated in FIG. 7A, and then transmits the above-mentioned status information to the CPU 950. This state is a state in which the trailing edge guide 504 is not correctly positioned in such a way as to contact the end surface of the sheet stack 501. In this instance, the trailing-edge rough-setting detection processing ends.

If the CPU 950 determines that the status information indicating that the warning display on the display portion 620 has been canceled by the user has not been received from the CPU 901 (NO in step S1208), then in step S1209, the CPU 950 determines whether the type of sheets stored in the sheet storage portion 503 has been re-set to "envelope". If the sheet type is not "envelope" (NO in step S1209), then in step S1204, the CPU 950 re-determines whether the door of the sheet storage portion 503 has been opened. If the sheet type is "envelope" (YES in step S1209), the CPU 950 re-performs determination processing in step S1200. Furthermore, step S1204 is processing provided in preparation for a case where the user has consciously re-set the sheet type to "envelope".

If, in step S1208, the status information indicating that the warning display has been canceled by the user has been received from the CPU 901 (YES in step S1208), then in step S1207, the CPU 950 clears the variable FLAG, and then re-performs determination processing in step S1200.

Figure 12:
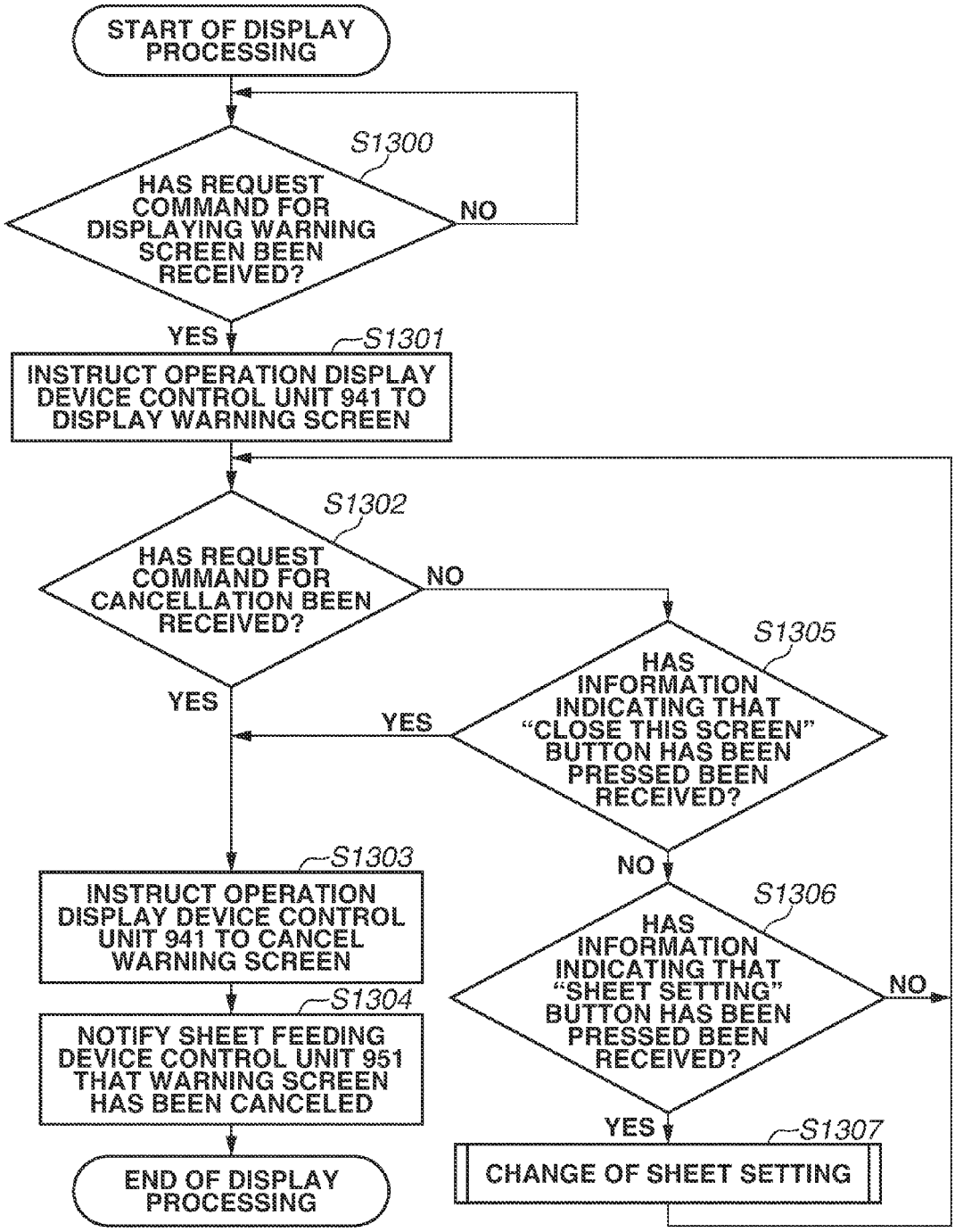
FIG. 12 is a flowchart illustrating display control in the trailing-edge rough-setting detection.

Next, display control in the trailing-edge rough-setting detection is described with reference to the flowchart of FIG. 12. Processing for this display control is periodically performed by the CPU 901 at intervals of a predetermined time.

In step S1300, the CPU 901 determines whether the request command for displaying the warning screen has been received from the CPU 950 of the sheet feeding device control unit 951. Processing in step S1300 is repeated until the request command is received. If the request command has been received (YES in step S1300), then in step S1301, the CPU 901 notifies the operation display device control unit 941 of a request for displaying the warning screen. With this request, the warning screen illustrated in FIG. 10 is displayed on the operation portion 620.

Then, in step S1302, the CPU 901 determines whether the request command for canceling the warning display has been received from the CPU 950. If the request command for canceling the warning display has been received (YES in step S1302), then in step S1303, the CPU 901 notifies the operation display device control unit 941 of a request for canceling displaying of the warning screen. In step S1304, the CPU 901 notifies the CPU 950 that the warning screen on the display portion 620 has been canceled.

If the request command for canceling the warning display has not been received (NO in step S1302), then in step S1305, the CPU 901 determines whether status information indicating that the "close this screen" button in the warning screen illustrated in FIG. 10 has been pressed has been received from the operation display device control unit 941.

If the status information indicating that the "close this screen" button has been pressed has not been received (NO in step S1305), then in step S1306, the CPU 901 determines whether status information indicating that the "sheet setting" button in the warning screen illustrated in FIG. 10 has been pressed has been received from the operation display device control unit 941. If the status information indicating that the "sheet setting" button has been pressed has been received (YES in step S1306), then in step S1307, the CPU 901 performs the above-described sheet setting change processing illustrated in FIG. 11, and then re-performs determination processing in step S1302. If the status information indicating that the "sheet setting" button has been pressed has not been received (NO in step S1306), the CPU 901 re-performs determination processing in step S1302.

As described above, according to the present exemplary embodiment, since, if the sheet type in the sheet storage portion is set to "envelope", a warning display caused by trailing-edge rough-setting detection is not provided, the user can be prevented from performing an extra operation and, thus, operability can be improved.

Figure 13:
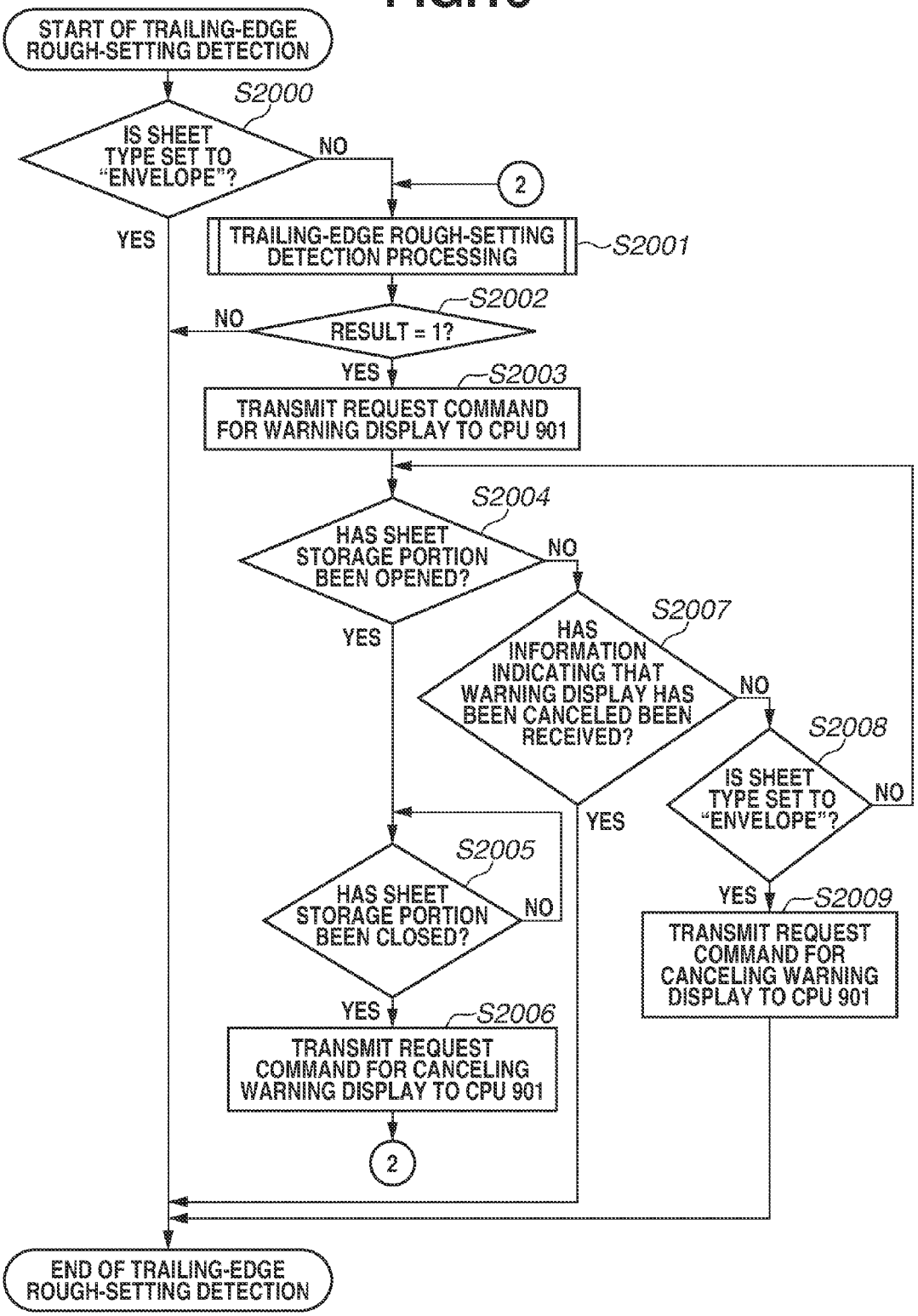
FIG. 13 is a flowchart illustrating the entire processing for a trailing-edge rough-setting detection operation according to a second exemplary embodiment.
Figure 14:
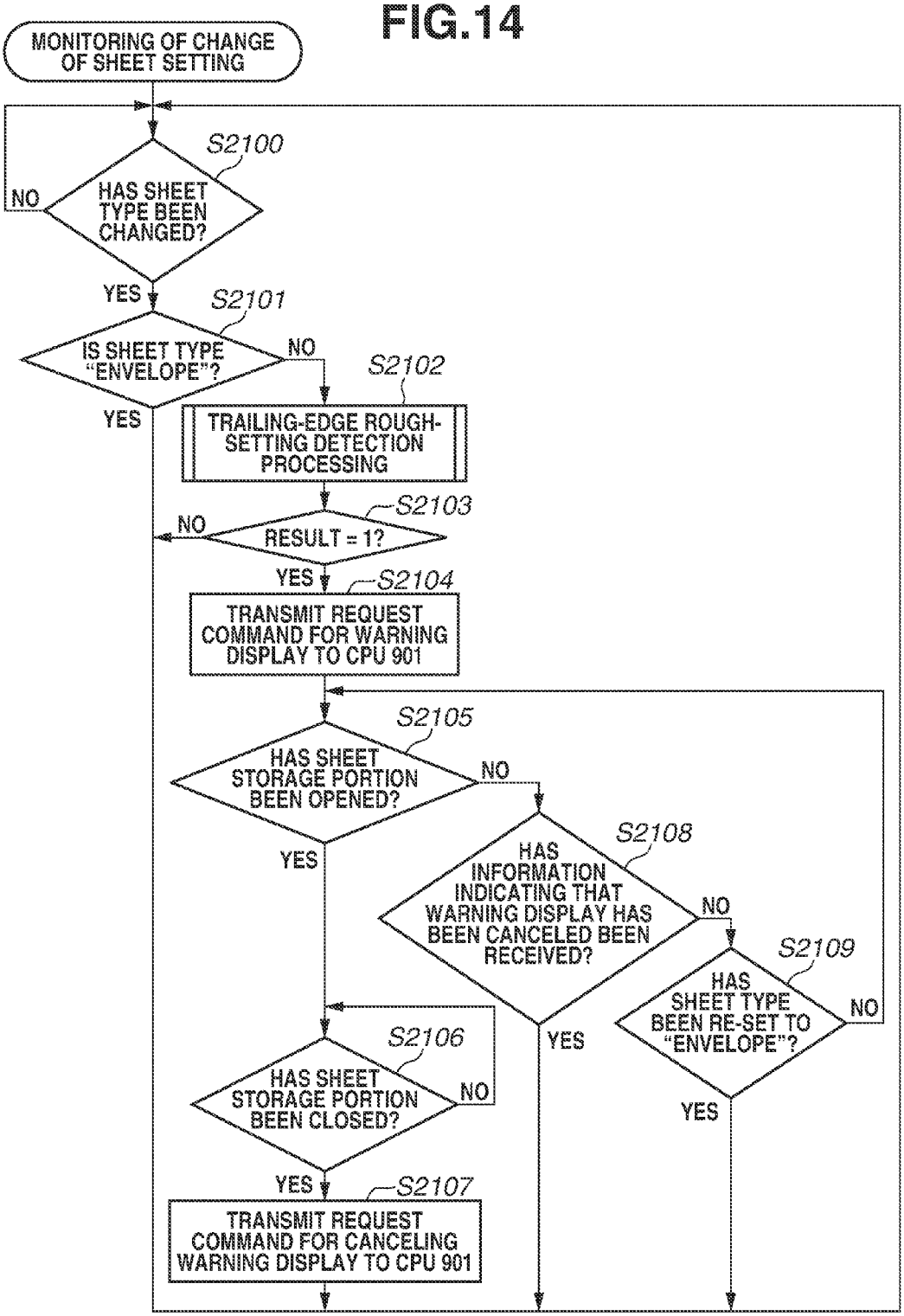
FIG. 14 is a flowchart illustrating processing for monitoring a change of sheet setting according to the second exemplary embodiment.

Next, a trailing-edge rough-setting detection operation according to a second exemplary embodiment of the present invention is described with reference to the flowcharts of FIGS. 13 and 14. Processing illustrated in FIGS. 13 and 14 is performed by the CPU 950 of the sheet feeding device control unit 951.

In the second exemplary embodiment, if the type of sheets stored in a sheet storage portion is set to "envelope", the trailing-edge rough-setting detection processing illustrated in the flowchart of FIG. 8 is not performed. Then, when the setting of the sheet type is changed from "envelope" to another type, the trailing-edge rough-setting detection processing is performed anew.

First, in step S2000, the CPU 950 determines whether the type of sheets stored in the sheet storage portion 503 is set to "envelope". If the sheet type is set to "envelope" (YES in step S2000), the CPU 950 terminates the trailing-edge rough-setting detection operation without performing the trailing-edge rough-setting detection processing (step S2001 and the flowchart of FIG. 8). Accordingly, in a case where envelopes are stored in the sheet storage portion 503, the warning screen illustrated in FIG. 10 can be prevented from being displayed in a situation such as that illustrated in FIG. 2C.

On the other hand, if the sheet type is not set to "envelope" (NO in step S2000), then in step S2001, the CPU 950 performs the trailing-edge rough-setting detection processing. In step S2002, the CPU 950 determines whether the value of the variable RESULT indicating a result of the trailing-edge rough-setting detection processing is "1". If the value of the variable RESULT is "0" (NO in step S2002), the CPU 950 terminates the trailing-edge rough-setting detection.

If the value of the variable RESULT is "1" (YES in step S2002), since this indicates that the trailing edge guide 504 is not correctly positioned, then in step S2003, the CPU 950 transmits, to the CPU 901, a command requesting displaying of a warning screen. The warning display mentioned in step S2003 is similar to that in the first exemplary embodiment. Subsequent processing in steps S2004 to S2009 is similar to the processing in steps S1104 to S1109 illustrated in FIG. 9.

Next, processing for monitoring a change of setting of the type of sheets stored in the sheet storage portion 503 according to the second exemplary embodiment is described with reference to the flowchart of FIG. 14. This processing is periodically performed by the CPU 950 at intervals of a predetermined time. In this processing, when the sheet type is changed from "envelope" to another type in a case where it has been detected that the trailing edge guide 504 is in a rough setting state, as mentioned in the foregoing, the user is informed that the trailing edge guide 504 is in a rough setting state.

In step S2100, the CPU 950 determines whether the sheet setting in the sheet storage portion 503 has been changed. The CPU 950 repeats step S2100 until it is determined that the sheet setting has been changed.

If the CPU 950 determines that the sheet setting in the sheet storage portion 503 has been changed (YES in step S2100), then in step S2101, the CPU 950 determines whether the changed sheet type is "envelope".

If the CPU 950 determines that the changed sheet type is "envelope" (YES in step S2101), the CPU 950 returns to step S2100 without performing the trailing-edge rough-setting detection processing illustrated in FIG. 8, thus repeating similar processing.

If the CPU 950 determines that the changed sheet type is other than "envelope" (NO in step S2101), then in step S2102, the CPU 950 performs the trailing-edge rough-setting detection processing illustrated in FIG. 8.

Then, in step S2103, the CPU 950 determines whether the value of the variable RESULT indicating a result of the trailing-edge rough-setting detection processing performed in step S2102 is "1". If the value of the variable RESULT is "0", in other words, if the trailing edge guide 504 is not in a rough setting state (NO in step S2103), the CPU 950 returns to step S2100, thus repeating similar processing.

If the value of the variable RESULT is "1" (YES in step S2103), the CPU 950 performs processing in step S2104 and subsequent steps. Since processing in steps S2104 to S2109 is similar to the processing in steps S1203 to S1206, S1208, and S1209, the detailed description thereof is omitted. Furthermore, in the processing illustrated in FIGS. 13 and 14, since the determination for the variable FLAG is not performed, processing in step S1207 illustrated in FIG. 11 is not performed in the processing illustrated in FIG. 14.

According to the second exemplary embodiment, in a case where the type of sheets stored in the sheet storage portion 503 is set to "envelope", since the trailing-edge rough-setting detection processing illustrated in FIG. 8 is not performed, even if the state illustrated in FIG. 2C occurs, any wasteful warning screen is not displayed. Accordingly, the user can be prevented from performing an extra operation and, thus, operability can be improved.

In the above-described exemplary embodiments, although processing performed with respect to the sheet storage portion 503 has been described, the same can be similarly applied to the other sheet storage portions of the sheet feeding device 2 and the image forming apparatus 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-085302 filed Apr. 17, 2015, which is hereby incorporated by reference herein in its entirety.

What is claimed is:

1. An image forming apparatus comprising:

a storage portion configured to store a sheet stack including a plurality of sheets;

a setting unit configured to set a type of sheets that are stored in the storage portion, wherein the setting unit is settable with at least a first type representing an envelope having thickness that is different between a leading edge side and a trailing edge side in a feeding direction and a second type representing a sheet different from the envelope;

a lifting and lowering portion configured to move up and down the sheet stack stored in the storage portion;

a feeding portion configured to feed a sheet from the sheet stack stored in the storage portion;

a regulation member being movable and configured to regulate a position on a trailing edge side of the sheet stack stored in the storage portion in a feeding direction in which the feeding portion feeds a sheet;

a display unit configured to display information;

a trailing edge detection portion being movable together with the regulation member and configured to detect a sheet surface on the trailing edge side of the sheet stack; and a control unit configured to perform a determining operation for determining whether the regulation member is positioned to an end surface on the trailing edge side of the sheet stack based on a result of detection by the trailing edge detection portion, and configured to cause the display unit to provide a warning display if it is determined that the regulation member is not positioned to the end surface, wherein, in a case where the first type is set by the setting unit, the control unit does not cause the display unit to provide the warning display even if the sheet surface is not detected by the trailing edge detection portion, and wherein, in a case where the second type is set by the setting unit, the control unit causes the display unit to provide the warning display if the sheet surface is not detected by the trailing edge detection portion.

2. The image forming apparatus according to claim 1, wherein, even if it is determined that the regulation member is not positioned to the end surface, the control unit does not cause the display unit to provide the warning display in a case where the first type is set by the setting unit.

3. The image forming apparatus according to claim 2, wherein, in a case where it is determined that the regulation member is not positioned to the end surface and the first type is set by the setting unit, the control unit causes the display unit to provide the warning display when the type of sheets is changed by the setting unit to a type of sheet other than the first type.

4. The image forming apparatus according to claim 2, wherein, in a case where it is determined that the regulation member is not positioned to the end surface and the first type is not set by the setting unit, the control unit cancels the warning display when the first type is set by the setting unit before the regulation member is corrected in position.

5. The image forming apparatus according to claim 2, wherein, in a case where it is determined that the regulation member is not positioned to the end surface and the warning display is not provided, the control unit causes the display unit to provide the warning display when the type of sheets is changed by the setting unit to a type of sheet other than the first type.

6. The image forming apparatus according to claim 1, wherein, in a case where the first type is set by the setting unit, the control unit does not perform the detection operation.

7. The image forming apparatus according to claim 6, wherein, in a case where the first type is set by the setting unit, the control unit performs the detection operation when the type of sheets is changed by the setting unit to a type of sheet other than the first type.

8. The image forming apparatus according to claim 1, wherein, in a case where it is determined that the regulation member is not positioned to the end surface, the control unit causes the display unit to provide a display prompting correcting the regulation member in position.

9. The image forming apparatus according to claim 1, wherein, in a case where it is determined that the regulation member is not positioned to the end surface, the control unit causes the display unit to provide a display prompting re-setting the type of sheets.

10. The image forming apparatus according to claim 1, wherein the envelope is stored in the storage portion in such a manner that a side of the envelope with the smaller thickness is set as the trailing edge side in the feeding direction.

11. An image forming apparatus comprising:

a storage portion configured to store a sheet stack including a plurality of sheets;

a setting unit configured to set a type of sheets that are stored in the storage portion;

a lifting and lowering portion configured to move up and down the sheet stack stored in the storage portion;

a feeding portion configured to feed a sheet from the sheet stack stored in the storage portion;

a regulation member being movable and configured to regulate a position on a trailing edge side of the sheet stack stored in the storage portion in a feeding direction in which the feeding portion feeds a sheet;

a display unit configured to display information;

a trailing edge detection portion being movable together with the regulation member and configured to detect a sheet surface on the trailing edge side of the sheet stack;

a control unit configured to perform a detection operation for detecting whether the regulation member is positioned to an end surface on the trailing edge side of the sheet stack based on a result of detection by the trailing edge detection portion, and configured to cause the display unit to provide a warning display if it is detected that the regulation member is not positioned to the end surface; and, a storage unit configured to store information indicating that it is detected that the regulation member is not positioned to the end surface and the warning display is not provided, wherein, in a case where it is detected that the regulation member is not positioned to the end surface and the warning display is not provided, the control unit causes the display unit to provide the warning display when the type of sheets is changed by the setting unit to a type of sheet other than a predetermined sheet, and wherein, in a case where the control unit has caused the display unit to provide the warning display in response to the type of sheets being changed by the setting unit to a type of sheet other than the predetermined sheet, the control unit deletes storage of the information.

12. The image forming apparatus according to claim 11, wherein the predetermined sheet includes an envelope.

13. A sheet feeding device connectable to an image forming apparatus including a setting unit configured to set a type of sheets that are stored in the sheet feeding device, and settable with at least a first type representing an envelope having thickness that is different between a leading edge side and a trailing edge side in a feeding direction and a second type representing a sheet different from the envelope, the sheet feeding device comprising:

a storage portion configured to store a sheet stack including a plurality of sheets;

an obtaining portion configured to obtain a type of sheet set by the setting unit;

a lifting and lowering portion configured to move up and down the sheet stack stored in the storage portion;

a feeding portion configured to feed a sheet from the sheet stack stored in the storage portion to the image forming apparatus connected to the sheet feeding device;

a regulation member being movable and configured to regulate a position on a trailing edge side of the sheet stack stored in the storage portion in a feeding direction in which the feeding portion feeds a sheet;

a trailing edge detection portion being movable together with the regulation member and configured to detect a sheet surface on the trailing edge side of the sheet stack; and a control unit configured to perform a determining operation for determining whether the regulation member is positioned to an end surface on the trailing edge side of the sheet stack based on a result of detection by the trailing edge detection portion, and configured to transmit, to the image forming apparatus, an instruction for providing a warning, if it is determined that the regulation member is not positioned to the end surface, wherein, in a case where a type of sheet obtained by the obtaining portion is the first type, the control unit does not transmit the instruction even if the sheet surface is not detected by the trailing edge detection portion, and wherein, in a case where a type of sheet obtained by the obtaining portion is the second type, the control unit causes the display unit to provide the warning display if the sheet surface is not detected by the trailing edge detection portion.

14. The sheet feeding device according to claim 13, wherein, even if it is determined that the regulation member is not positioned to the end surface, the control unit does not transmit the instruction in a case where a type of sheet obtained by the obtaining portion is the first type.

15. The sheet feeding device according to claim 13, wherein, in a case where a type of sheet obtained by the obtaining portion is the first type, the control unit does not perform the determining operation.

* * * * *